US007285079B2

(12) United States Patent
Mandell

(10) Patent No.: US 7,285,079 B2
(45) Date of Patent: Oct. 23, 2007

(54) EXERCISE DEVICE AND METHODS

(75) Inventor: Steven T. Mandell, 387 Delta Rd., Highland Park, IL (US) 60035

(73) Assignee: Steven T. Mandell, Highland Park, IL (US)

( * ) Notice: Subject to any disclaimer, the term of this patent is extended or adjusted under 35 U.S.C. 154(b) by 0 days.

(21) Appl. No.: 11/083,147

(22) Filed: Mar. 16, 2005

(65) Prior Publication Data

US 2006/0211551 A1 Sep. 21, 2006

(51) Int. Cl.
*A63B 21/02* (2006.01)

(52) U.S. Cl. ..... 482/126; 482/62

(58) Field of Classification Search ..... 482/38, 482/62, 121–130; D21/665, 679
See application file for complete search history.

(56) References Cited

U.S. PATENT DOCUMENTS

| | | | | |
|---|---|---|---|---|
| 3,842,453 | A | 10/1974 | Redfield | |
| 4,067,326 | A | 1/1978 | Lay | |
| 4,489,937 | A * | 12/1984 | Kong | 482/126 |
| 4,735,412 | A | 4/1988 | Prsala | |
| 5,022,648 | A * | 6/1991 | Travis | 482/126 |
| 5,267,929 | A * | 12/1993 | Chen | 482/128 |
| 5,514,058 | A * | 5/1996 | Buoni et al. | 482/124 |
| 5,529,562 | A | 6/1996 | Glaser | |
| 5,743,830 | A * | 4/1998 | Ho | 482/44 |
| 5,876,361 | A | 3/1999 | Harris | |
| 5,957,820 | A * | 9/1999 | Zarillo et al. | 482/121 |
| 6,022,302 | A * | 2/2000 | McBride | 482/121 |
| 6,176,817 | B1 | 1/2001 | Carey et al. | |
| 6,293,893 | B1 * | 9/2001 | Truchelut | 482/121 |
| 6,447,430 | B1 | 9/2002 | Webb et al. | |
| 6,575,880 | B1 | 6/2003 | Hengtrakulsin | |
| 6,579,212 | B2 | 6/2003 | Panatta | |
| 6,730,006 | B1 | 5/2004 | Patterson | |
| 6,746,385 | B1 | 6/2004 | Habing | |
| 6,752,747 | B2 * | 6/2004 | Yu | 482/110 |
| 6,872,174 | B2 * | 3/2005 | Benach | 482/121 |
| 6,939,277 | B2 * | 9/2005 | Tuller et al. | 482/140 |
| 2002/0002104 | A1 | 1/2002 | Panatta | |
| 2004/0015108 | A1 | 1/2004 | McNally et al. | |
| 2004/0185987 | A1 | 9/2004 | Ruzansky | |

(Continued)

*Primary Examiner*—Lori Amerson
(74) *Attorney, Agent, or Firm*—Katten Muchin Rosenman LLP; John S. Paniaguas

(57) ABSTRACT

A portable exercise device is disclosed for improving a user's posture. Even though the exercise device is portable, it provides an active workout of those muscles involved in maintaining correct posture. In accordance with an important aspect of the invention, the exercise device in accordance with the present invention includes a spacer. One end of the spacer is placed against the user's body and the other end forms a fixed pivot point for the device. In one embodiment of the invention, the exercise device includes a pair of spaced apart handle bars coupled to a flexible member and a spacer for spacing the device away from the user's body. The spacer may either be a separate device or integrally formed with the other members. With the handle bars spaced away from the user's body, the spacer allows the user to repetitively bend and straighten the flexible member to strengthen those muscles associated with proper posture. Alternate embodiments of the exercise bar include an adjustable tension mechanism and an adjustment mechanism for adjusting the distance between the handlebars. Also disclosed is various exercise methods for use with a flexible or deformable bar in which the user's body forms a fixed pivot point.

11 Claims, 19 Drawing Sheets

U.S. PATENT DOCUMENTS

2004/0185991 A1 9/2004 Bowman et al.
2004/0249313 A1 12/2004 Grace
2005/0202944 A1* 9/2005 Deal ..... 482/126
2005/0221965 A1* 10/2005 Boland ..... 482/121
2005/0233877 A1* 10/2005 Lin ..... 482/126

* cited by examiner

EXERCISE DEVICE AND METHODS

BACKGROUND OF THE INVENTION

1. Technical Field

The present invention relates to an exercise device and exercise methods and more particularly to an active exercise device that can be used to improve posture and various exercise methods for strengthening various muscles.

2. Description of the Prior Art

Proper poster is important for both health and appearance reasons. Indeed, it is well known that improper posture can lead to various health problems including chronic back pain. As such, over the years, a number of devices have been created to facilitate strengthening of certain muscles in the human body in order to improve a person's posture. These devices fall into two general categories: namely, portable devices and free standing devices. The portable devices may be further categorized as active and passive portable devices. Examples of passive devices are disclosed in U.S. Pat. Nos. 3,842,453 and 5,876,361; United States Patent Application Publication No. US 2004/0015108 A1, as well as Japanese Published Patent Application JP 2001-231883. U.S. Pat. No. 5,876,361, as well as Japanese Published Patent Application JP 2001-231883 disclose strap-on devices in which a user straps on a harness type device in a standing position. The harness type devices are configured to urge the wearer's body into a proper standing posture position.

Other passive devices for correcting posture are disclosed in U.S. Pat. No. 3,842,453 and United States Patent Application Publication No. US 2004/0015108 A1. The '453 Patent discloses a specially configured pillow that is intended to be positioned under the user while the user is lying down. The '453 Patent purports that the device stretches the user's spine to correct posture. United States Published Patent Application US 2004/0015108 A1 discloses a device configured to be used in a sitting position. The device disclosed in the '108 application is a pillow, configured to be used in a sitting position. The pillow is configured so that it creates a unstable surface for sitting, thus causing a user to flex certain back muscles while seated thereon to improve posture.

In order to intensify body posture training exercises, free standing exercise machines have been developed to improve posture. These machines generally fall into two categories. One category relates to single purpose free standing machines whose intended purpose is strictly for posture training. Examples of free standing machines in this category are disclosed in: U.S. Pat. No. 6,579,212; United States Patent Application Publication Nos. US 2002/0002104 A1 and 2004/0185991 A1; and UK Patent Application Publication No. GB 2 131 305 A. Unfortunately, single purpose free standing machines are relatively expensive and take up a substantial amount of floor space. In order to solve these problems, multiple purpose free standing exercise machines have been developed. Such multiple purpose free standing exercise machines are known to be configured to enable multiple exercises to be performed thereupon including one or more posture exercises. Examples of such multi-purpose machines are disclosed in: U.S. Pat. Nos. 6,176,817; 6,447,430; 6,575,880; and 6,746,385. A multiple purpose exercise machine is also disclosed in United States Patent Application Publication No. US 2004/0185987. Even though such multiple purpose exercise machines solve the problem of requiring a separate machine for posture exercises, such multi-purpose machines are still relatively large and take up a relatively large amount of floor space. As such, multi-purpose exercise machines have not been well received in the home use retail market. Thus, there is a need for an exercise device for enabling a user to perform posture correction exercises that is relatively inexpensive and does not require a lot of floor space.

SUMMARY OF THE INVENTION

Briefly, the present invention relates to an exercise device for improving a user's posture and exercise methods for strengthening various muscles. In accordance with an important aspect of the invention, the exercise device and method in accordance with the present invention are based upon a flexible exercise device that utilizes a fixed pivot point; either the user's body or by way of a spacer placed against the user's body. The portable exercise device in accordance with the present invention eliminates the problem associated with floor space attendant with relatively large free standing exercise machines. Even though the exercise device is portable, it provides an active workout of those muscles involved in maintaining correct posture. In one embodiment of the invention, the exercise device includes a pair of spaced apart handle bars coupled to a flexible member and a spacer for spacing the device away from the user's body. The spacer may either be a separate device or integrally formed with the device. One end of the spacer is supported by the user's body. The other end of the spacer forms a fixed pivot for the exercise device. With the handle bars spaced away from the user's body, the spacer allows the user to repetitively bend and straighten the flexible member to strengthen those muscles associated with proper posture. In accordance with another aspect of the invention, various exercise methods are disclosed in which the user's body is used as the fixed pivot point for the exercise device to exercise various muscles.

DESCRIPTION OF THE DRAWINGS

These an other advantages of the present invention will be readily understood with reference to the following specification and attached drawing, wherein.

DETAILED DESCRIPTION

Figure 39:
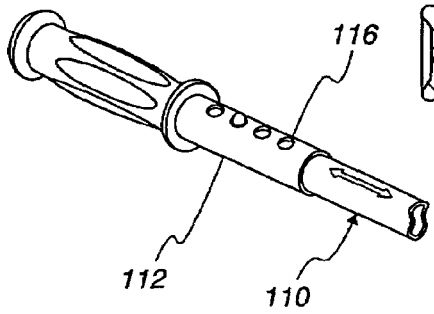
FIG. 39 is a partial isometric view of an alternative embodiment of the exercise bar illustrated in FIG. 5 with an exemplary adjustable length mechanism.
Figure 40:
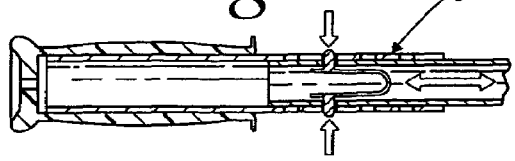
FIG. 40 is a partial side sectional view of the alternative embodiment illustrated in FIG. 39.
Figure 41:
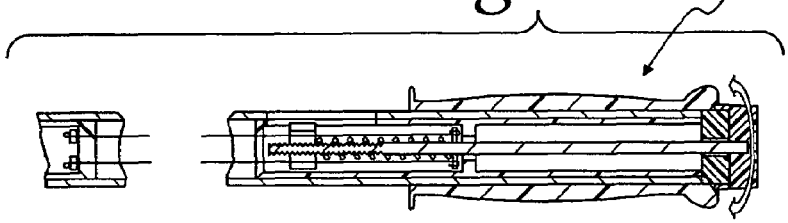
FIG. 41 is a partial sectional view of the exercise bar shown in FIG. 35 with another exemplary alternative embodiment of the tension mechanism, shown in a rest position at a first tension level.
Figure 42:
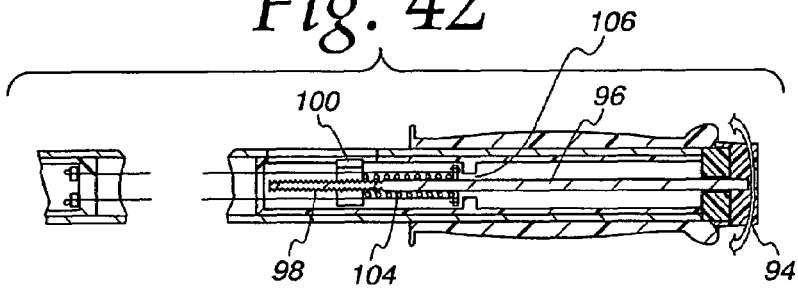
FIG. 42 is similar to FIG. 41, but shown at a second tension level.
Figure 43:
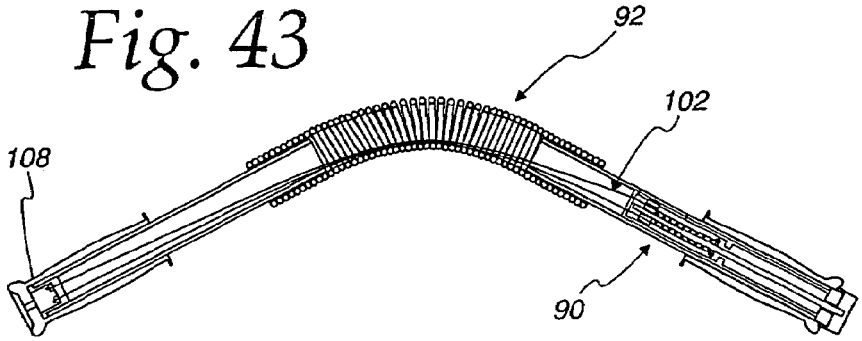
FIG. 43 is similar to FIG. 41, but shown in a flexed position.

The present invention relates to a portable exercise device for use in improving posture and an exercise method for strengthening various muscles. The exercise device is illustrated in FIGS. 1-4 while the exercise methods are illustrated in FIGS. 5-34. FIGS. 35-38 illustrate an alternate embodiment of the exercise device which includes a tension adjustment mechanism. FIGS. 41-43 illustrate an alternate embodiment of the exercise device with an alternative tension adjustment mechanism. FIGS. 39 and 40 illustrate another alternate embodiment of the exercise bar with an adjustable length mechanism.

In accordance with an important aspect of the invention, the portable exercise device utilizes the user's body as a pivot point. More particularly, the exercise device in accordance with the present invention includes a spacer which is placed against a user's body. The other end of the spacer forms a fixed pivot point for the exercise device formed as a deformable or flexible bar. The exercise methods in accordance with the present invention utilize the user's body directly as a fixed pivot point. Unlike other known portable exercise devices methods, the exercise device and methods in accordance with the present invention provides an active workout while not taking up the floor space or costing as much as a free standing exercise machine.

Exercise Device

Figure 1:
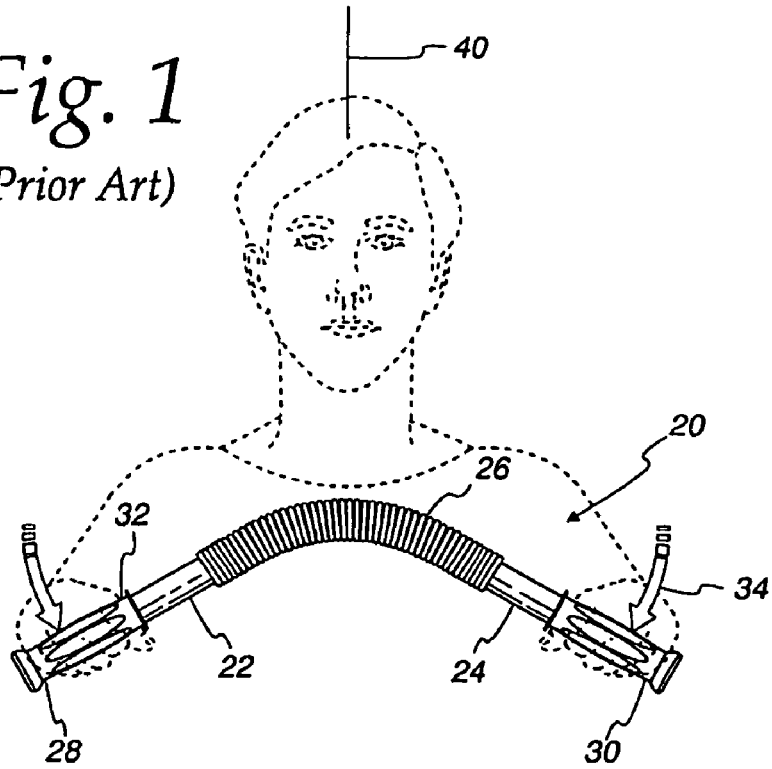
Fig. 1 (Prior Art)
FIG. 1 is a front view of a user using a known exercise device in its intended manner to strengthen arm muscles.

FIG. 1 illustrates a known portable exercise device, generally identified with the reference numeral 20. The prior art exercise device 20 includes a pair of rigid members or handlebars 22, 24, coupled together by a flexible coupling 26. As shown, a pair of handle grips 28, 30 are provided on the ends of the handlebars 22, 24. In operation, the user grasps the handle grips 28, 30 and flexes the coupling member 26 in the direction of the arrows 32, 34 during an initial stroke and releases the tension in the flexible member 26 on a release stroke. The device is repeatedly flexed as shown in FIG. 1 and released to a straight position (no shown). This action strengthens the user's arm muscles in its intended application. The exercise device illustrated in FIG. 1 is not intended and cannot be used for exercising back muscles associated with the user's posture.

Figure 2:
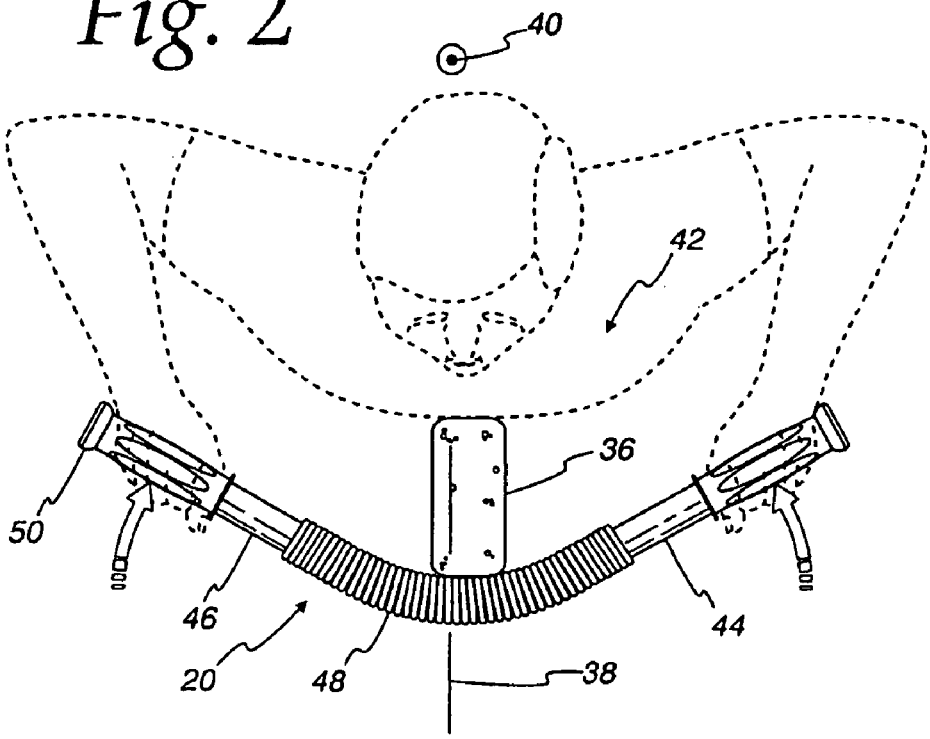
FIG. 2 is a top view of a user utilizing a simplified version of the exercise device in accordance with the present invention incorporating the known exercise device illustrated in FIG. 1 and illustrating the use of the user's body as a fixed pivot point.
Figure 3:
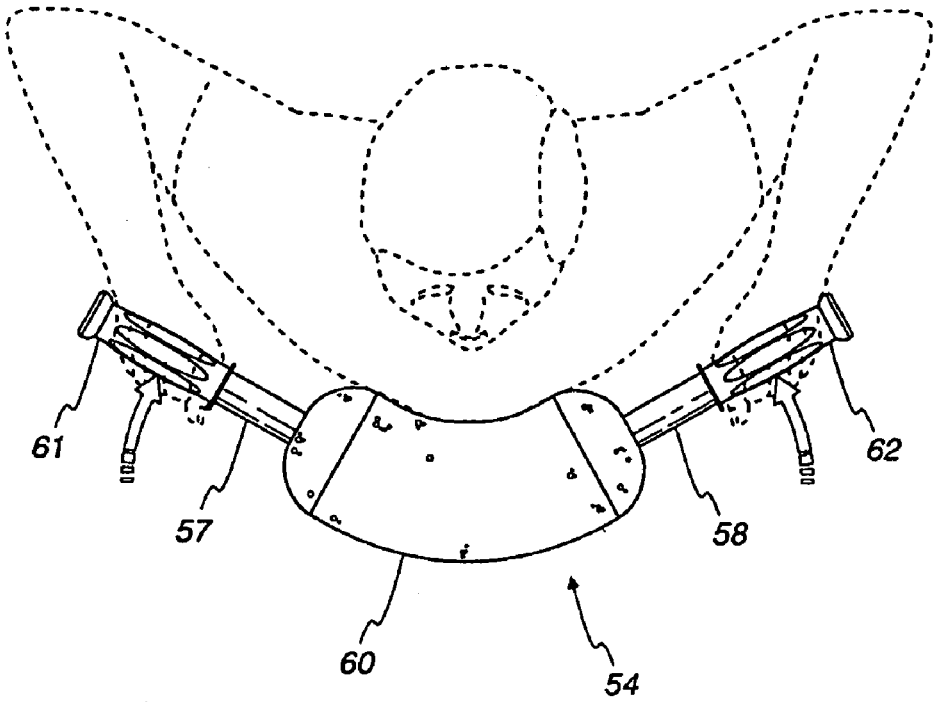
FIG. 3 is an alternate embodiment of the present invention illustrated in FIG. 2.
Figure 4:
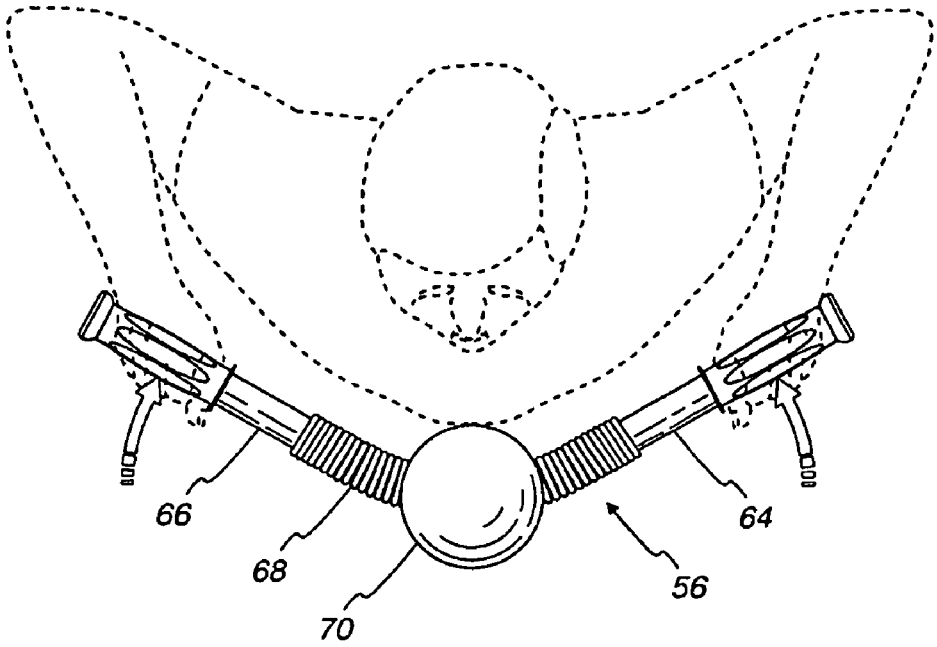
FIG. 4 is another alternate embodiment of the invention illustrated in FIG. 2.

FIGS. 2-4 illustrate one application of the invention which enables the user's body to be used as the pivot point for the exercise device. In particular, as shown in FIGS. 2-4, the exercise device in accordance with the present invention is placed against the user's chest. In operation, the user grasps the ends of the handle bars. In order to strengthen certain back muscles to improve posture, the user repetitively flexes the flexible coupling, which couples the handlebars together, and releases.

Other applications of the exercise device in accordance with the present invention are contemplated in which parts of the user's body, other than the chest, are used as the pivot point. All such applications which use any part of the user's body as a pivot point are considered to be within the broad scope of the present invention.

Referring to FIG. 2, a simplified version of the invention is illustrated. This embodiment may incorporate the known exercise device 20, illustrated in FIG. 1, or a functional equivalent of it. As shown, the exercise device 20 is spaced away from the user's chest by a spacer 36. The size of the spacer 36 is dependent on the size of the user but generally configured to space the balance of the components four inches or more away from the user's body. The spacer 36 allows the exercise device 20 to be used in a manner as illustrated in FIG. 2 to exercise the user's back muscles in order to improve posture. As further shown in FIG. 2, the pivot axis of the exercise device 20, when used with the spacer 36, is generally parallel to an axis 40 that is generally parallel to the user in a standing position. The spacer 36 allows the user to pull back on the handle grips 28, 30 in order to flex muscles in the user's back associated with posture. Without the spacer 36 a user would be unable to pull back on the handle-grips 28, 30 in the manner illustrated in FIG. 2, if the flexible member 26 was placed directly against the user's chest.

As shown in FIG. 2 and mentioned above, the exercise device in accordance with the present invention, generally identified with the reference numeral 42, may incorporate the known exercise device 20 or a functional equivalent of it. In general, this embodiment of the exercise devise 42 includes a pair of spaced apart members 44, 46, coupled together by a less rigid and flexible member 48, such as a spring or any member that is more flexible than said spaced apart members 44, 46. A pair of hand grips 50, 52 may optionally be provided on the ends of the rigid members 44, 46. In this embodiment, in order to cause the user's body to act as the pivot point, a spacer 36 is provided. The spacer 36 spaces the pivot axis 38 of the exercise device 42 away from the user's body to enable the user to operate the device.

Various embodiments of the spacer 36 are contemplated. For example, the spacer 36 may optionally be formed as a separate component, separate from the balance of the components of the exercise device 42, as generally shown in FIG. 2. Alternatively, the spacer 36 may be integrally formed with the device. Various shapes of the spacer are also contemplated. For example, the spacer 36 may be configured with a generally rectangular, cylindrical, spherical or irregular cross section. However, any shape which can be placed between the body of the user and the balance of the component can be used for the spacer 36.

Alternate embodiments of the invention are illustrated in FIGS. 3 and 4. Turning first to FIG. 3, a first alternate embodiment, generally identified with the reference numeral 54, includes a pair of rigid members 56, 58. As shown, the rigid members 56, 58 may be formed as hollow or solid tubular members, formed from virtually any rigid material, such as metal or plastic. The rigid members 56, 58 may be formed with virtually any cross-sectional area, such as square, rectangular, polygonal or even irregular. A pair of hand-grips 61, 62 may optionally be placed on the ends of the rigid members 56, 58. In the embodiment illustrated in FIG. 3, the rigid members 56, 58 may optionally be coupled to a coupling device 60 having a dual purpose of acting as a flexible member, as well as spacing the exercise device 54 from the user's body.

Many alternate embodiments of the coupling device 60 are contemplated. For example, the rigid members 56, 58 can be coupled together with a spring, for example, as illustrated in FIGS. 1 and 2, and covered with separate material which acts as a spacer that is flexible and deformable as shown. In other embodiments, the rigid members 56, 58 may be directly coupled to a molded plastic spacer material 60 that is less rigid than the members 56, 58.

FIG. 4 illustrates another alternate embodiment, generally identified with the reference numeral 56. In this embodiment, a pair of rigid members 64, 66 are directly coupled to a flexible coupling member 68, similar to that shown in FIGS. 1 and 2. In this embodiment, the spacer 70 is provided as non-deformable member, for example, a sphere, as shown. In this embodiment, the spacer 70 may be molded over the flexible member 68.

Figure 5:
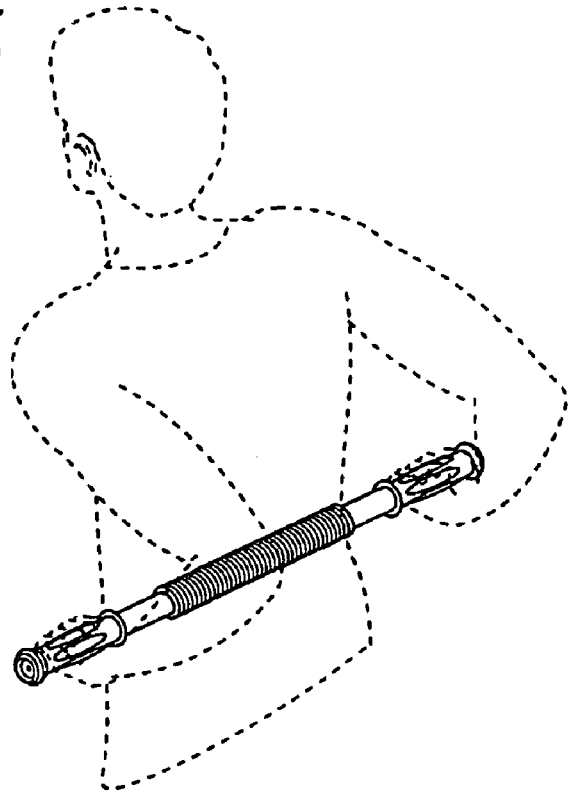
FIG. 5 illustrates an exercise method in accordance with the present invention for strengthening the stomach muscles in which a flexible bar is placed behind a user's back and grasped on both ends by the user's hands illustrating a relaxed position.
Figure 6:
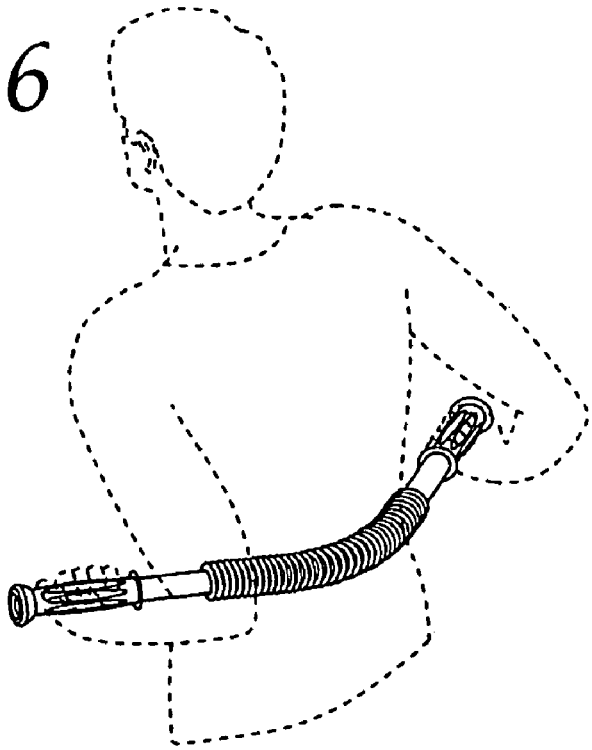
FIG. 6 is similar to FIG. 5 but illustrating a flexed position.
Figure 7:
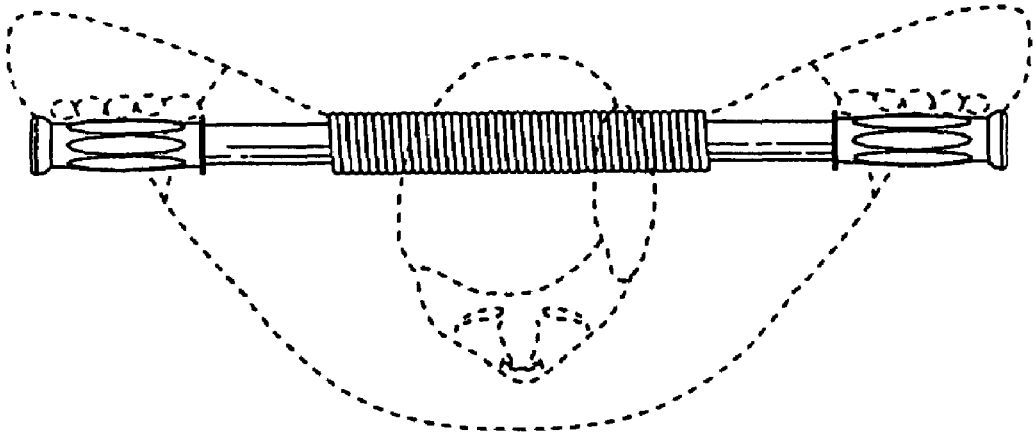
FIG. 7 illustrates another exercise method in accordance with the present invention for strengthening the chest muscles in which a flexible bar is placed behind a user's neck and held in place on both ends by the user's hands which may be flat and pointed up illustrating a relaxed position.
Figure 8:
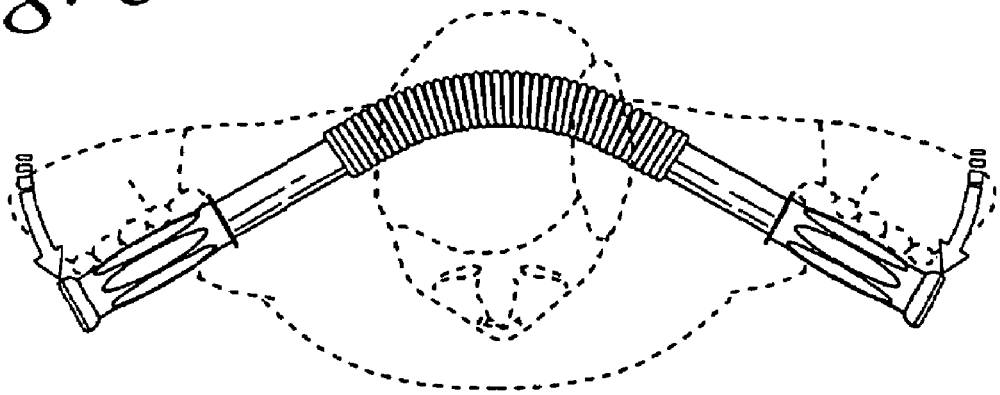
FIG. 8 is similar to FIG. 7 but illustrating a flexed position.
Figure 9:
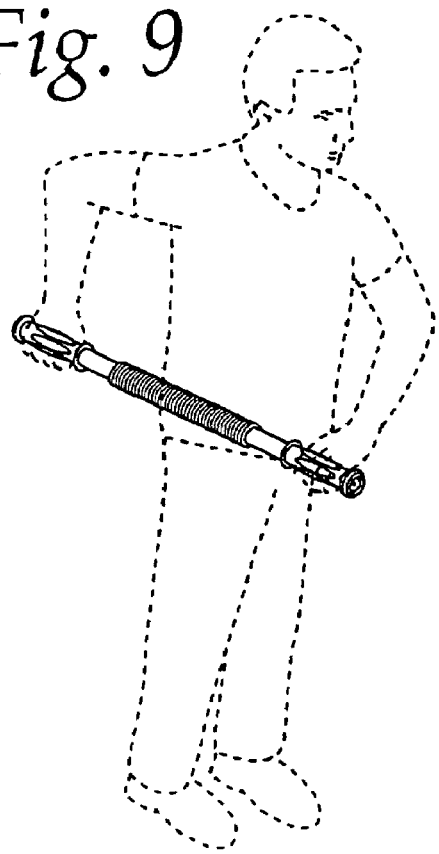
FIG. 9 illustrates another exercise method in accordance with the present invention for strengthening the oblique muscles in which a flexible bar is placed against a user's side and grasped on both ends by the user's hands illustrating a relaxed position.
Figure 10:
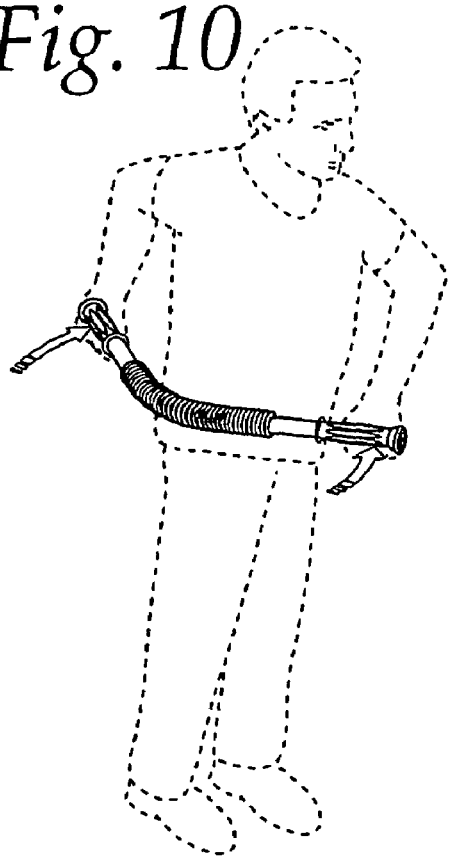
FIG. 10 is similar to FIG. 9 but illustrating a flexed position
Figure 11:
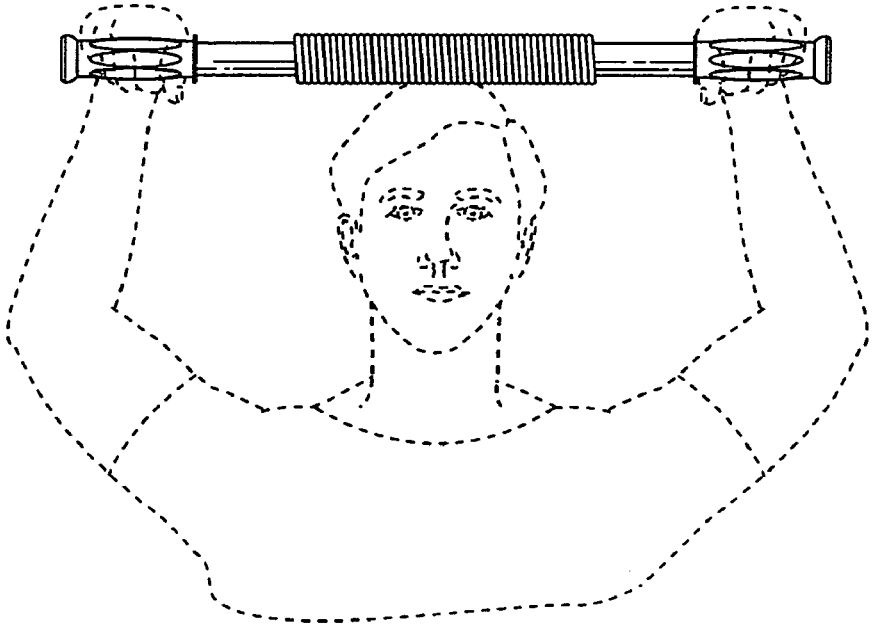
FIG. 11 illustrates another exercise method in accordance with the present invention for strengthening the lateral muscles in which a flexible bar is placed against a user's head and grasped on both ends by the user's hands illustrating a relaxed position.
Figure 12:
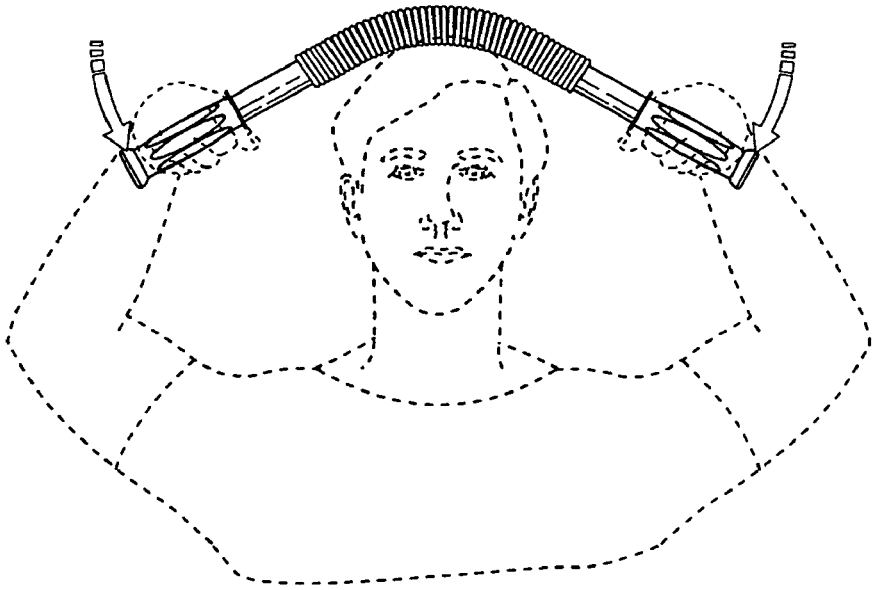
FIG. 12 is similar to FIG. 11 but illustrating a flexed position
Figure 13:
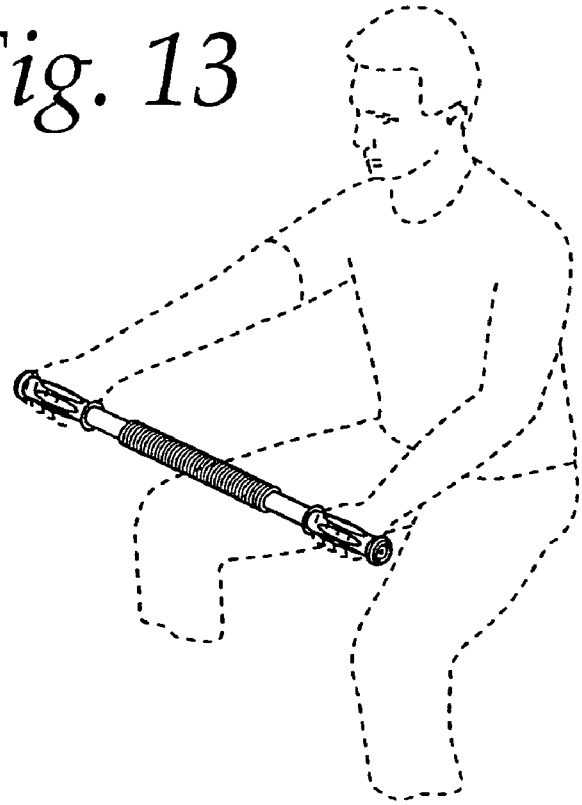
FIG. 13 illustrates another exercise method in accordance with the present invention for strengthening the triceps muscles in which a flexible bar is placed against the top of a user's knee in a sitting position and grasped on both ends by the user's hands illustrating a relaxed position.
Figure 14:
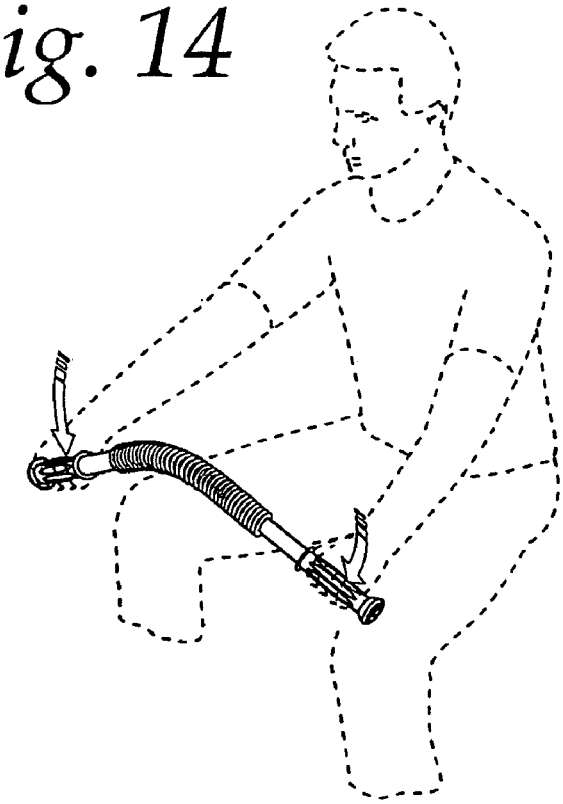
FIG. 14 is similar to FIG. 13 but illustrating a flexed position
Figure 15:
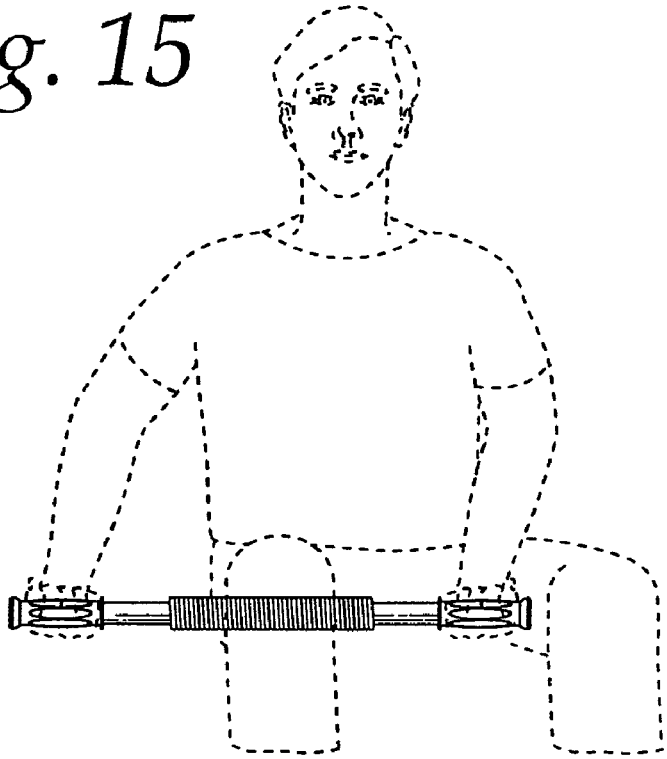
FIG. 15 illustrates another exercise method in accordance with the present invention for strengthening the triceps muscles in which a flexible bar is placed under a user's knee and grasped on both ends by the user's hands illustrating a relaxed position.
Figure 16:
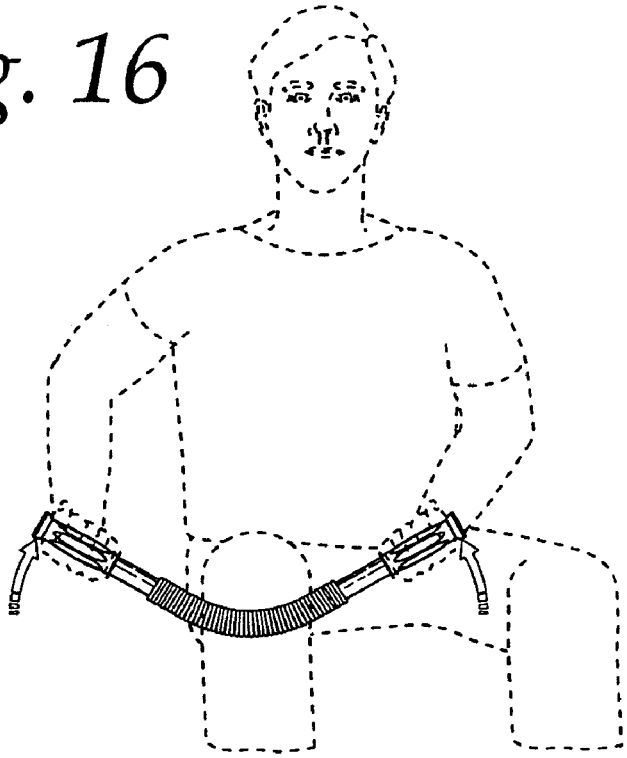
FIG. 16 is similar to FIG. 15 but illustrating a flexed position
Figure 17:
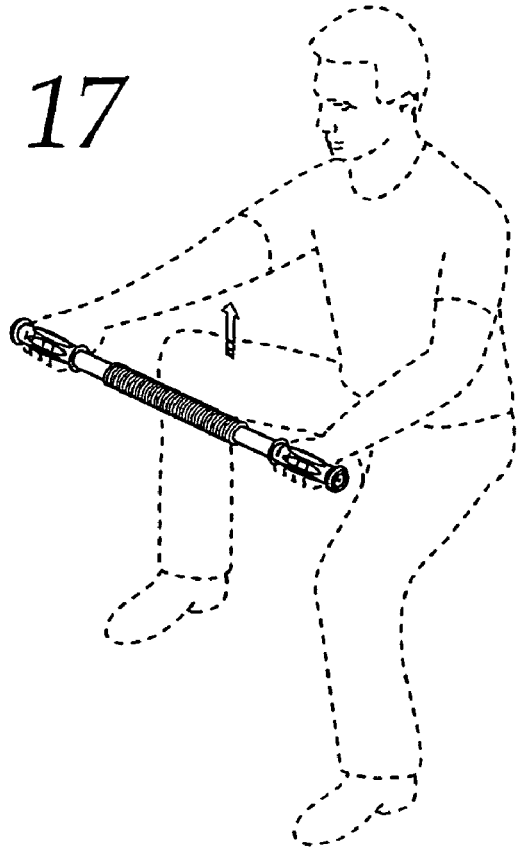
FIG. 17 illustrates another exercise method in accordance with the present invention for strengthening the back muscles in which a flexible bar is placed against a user's knee in a raised position and grasped on both ends by the user's hands illustrating a relaxed position.
Figure 18:
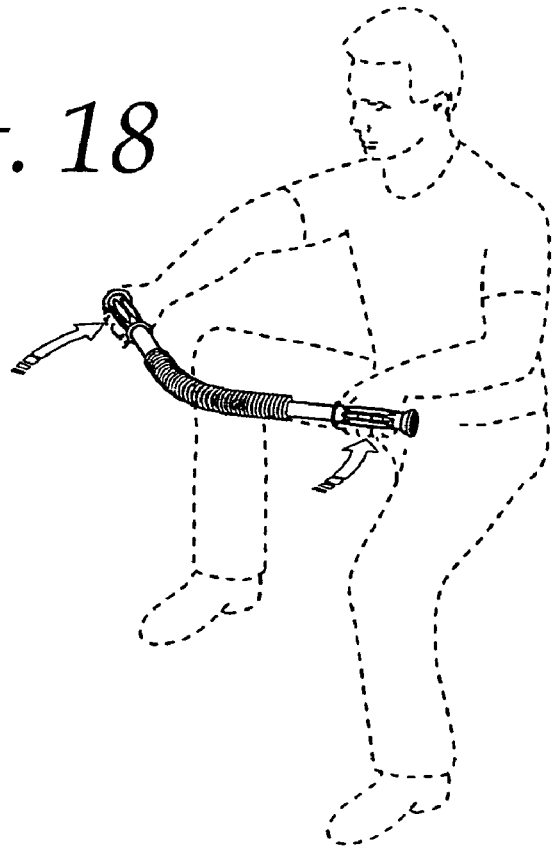
FIG. 18 is similar to FIG. 17 but illustrating a flexed position
Figure 19:
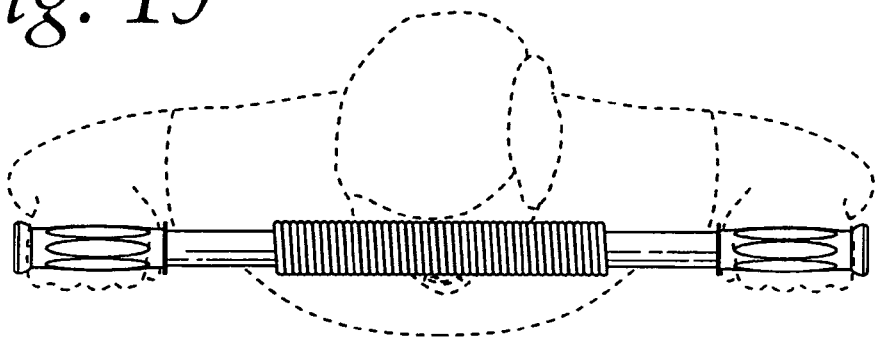
FIG. 19 illustrates another exercise method in accordance with the present invention for strengthening the shoulder muscles in which a flexible bar is placed against a user's forehead and grasped on both ends by the user's hands illustrating a relaxed position.
Figure 20:
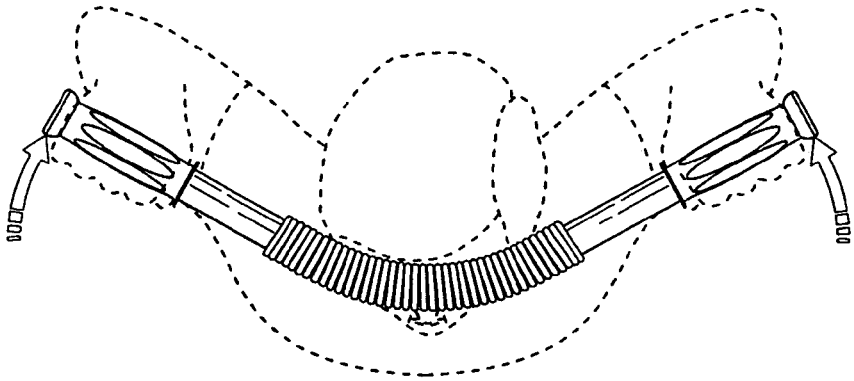
FIG. 20 is similar to FIG. 19 but illustrating a flexed position
Figure 21:
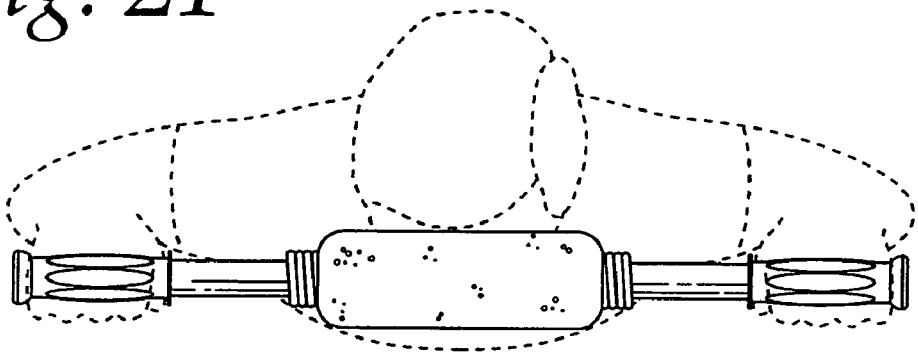
FIG. 21 is similar to FIG. 19 but illustrating the use of a padded exercise device.
Figure 22:
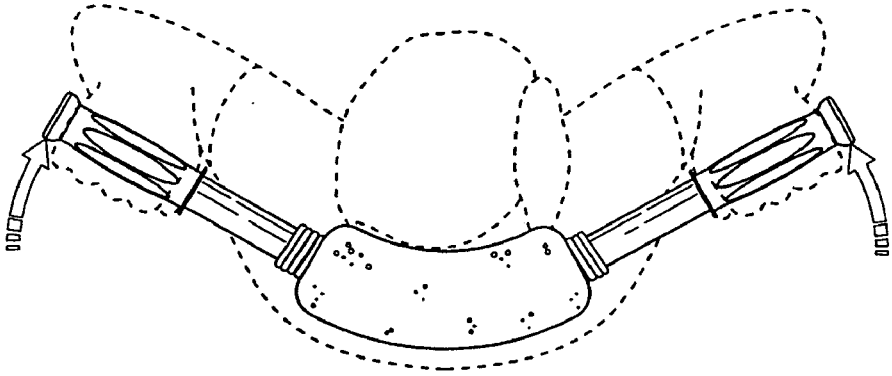
FIG. 22 is similar to FIG. 20 but illustrating a padded exercise device.
Figure 23:
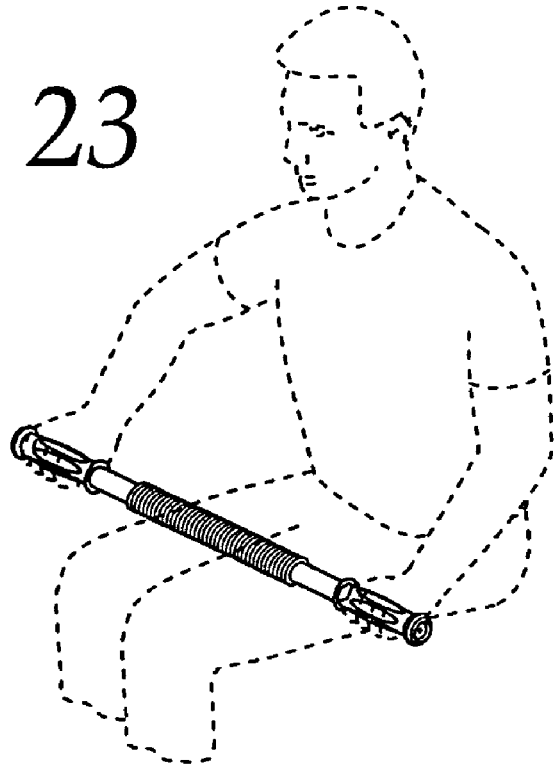
FIG. 23 illustrates another exercise method in accordance with the present invention for strengthening the chest muscles in which a flexible bar is placed over both knees of a user and grasped on both ends by the user's hands illustrating a relaxed position.
Figure 24:
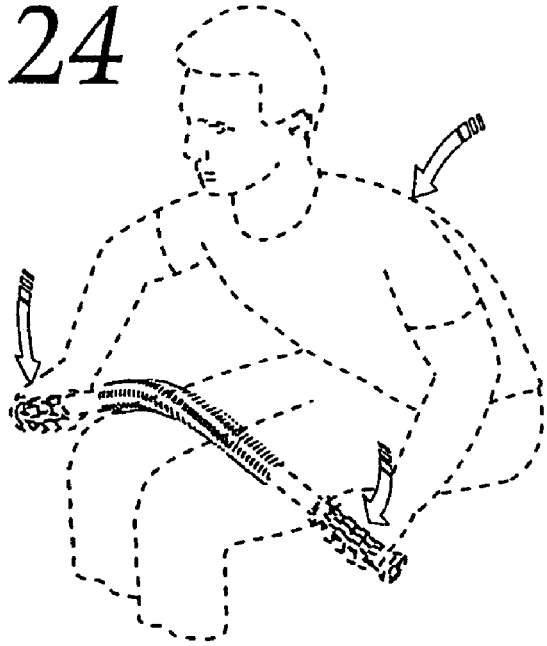
FIG. 24 is similar to FIG. 23 but illustrating the user bending forward to place the flexible bar in a flexed position
Figure 25:
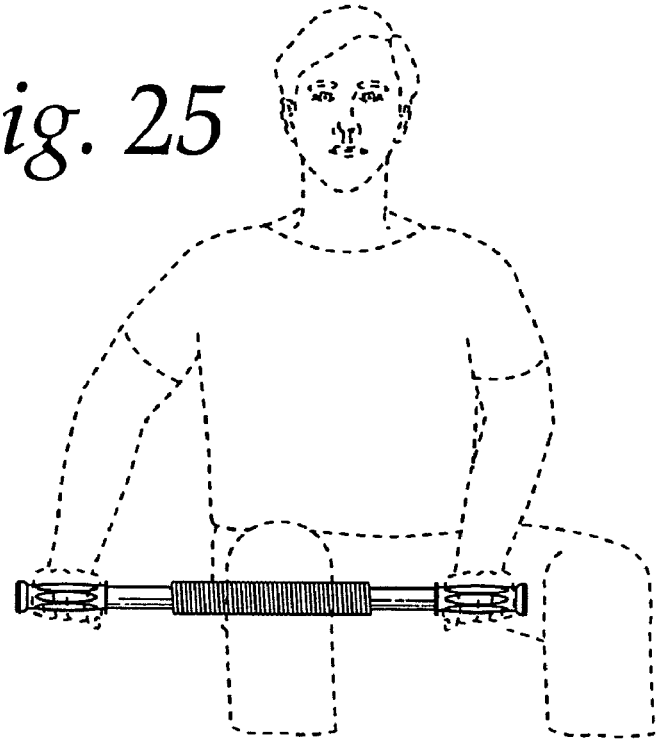
FIG. 25 illustrates another exercise method in accordance with the present invention for strengthening the deltoid muscles in which a flexible bar is placed under one knee of a user and grasped on both ends by the user's hands illustrating a relaxed position.
Figure 26:
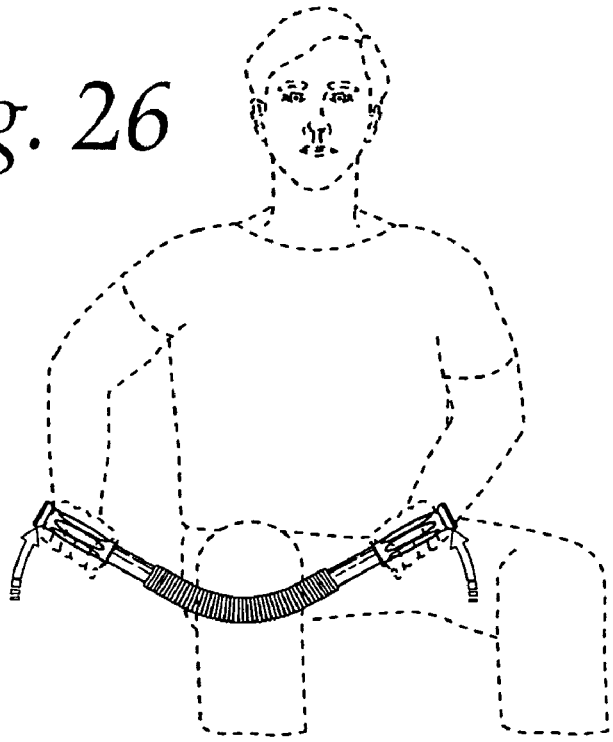
FIG. 26 is similar to FIG. 25 but illustrating a flexed position
Figure 27:
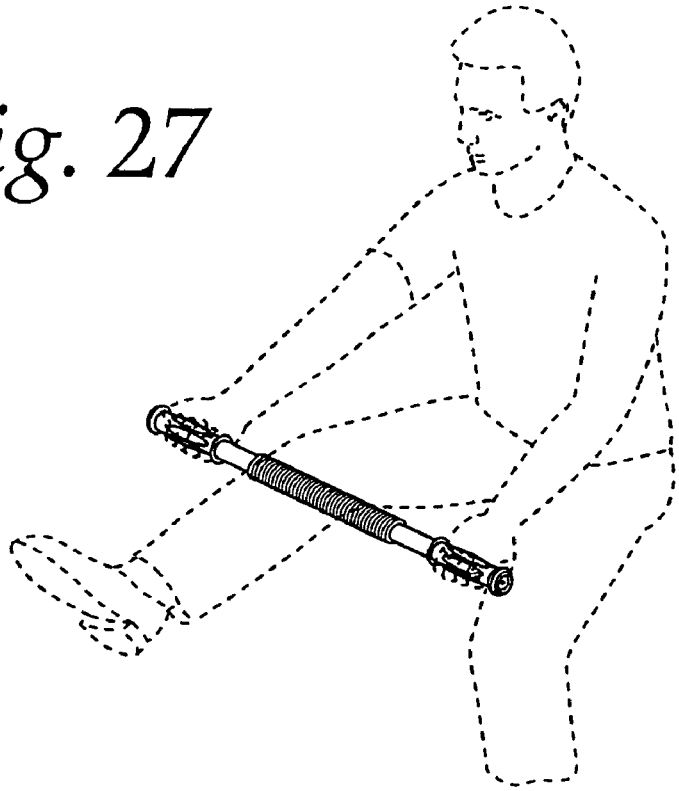
FIG. 27 illustrates another exercise method in accordance with the present invention for strengthening the ham string muscles in which a flexible bar is placed under a user's knee joint while the user's leg is in an extended position while the flexible bar is grasped on both ends by the user's hands illustrating a relaxed position.
Figure 28:
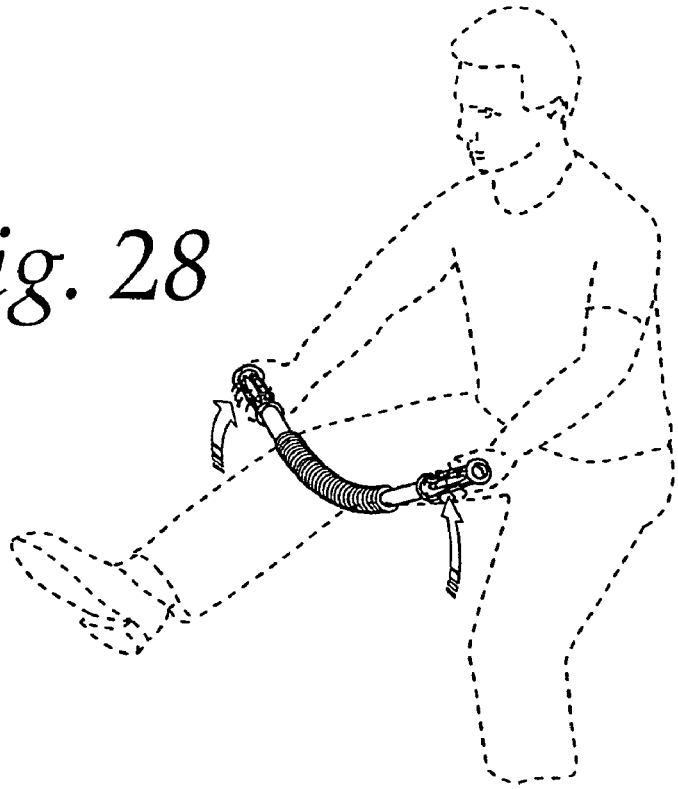
FIG. 28 is similar to FIG. 27 but illustrating a flexed position
Figure 29:
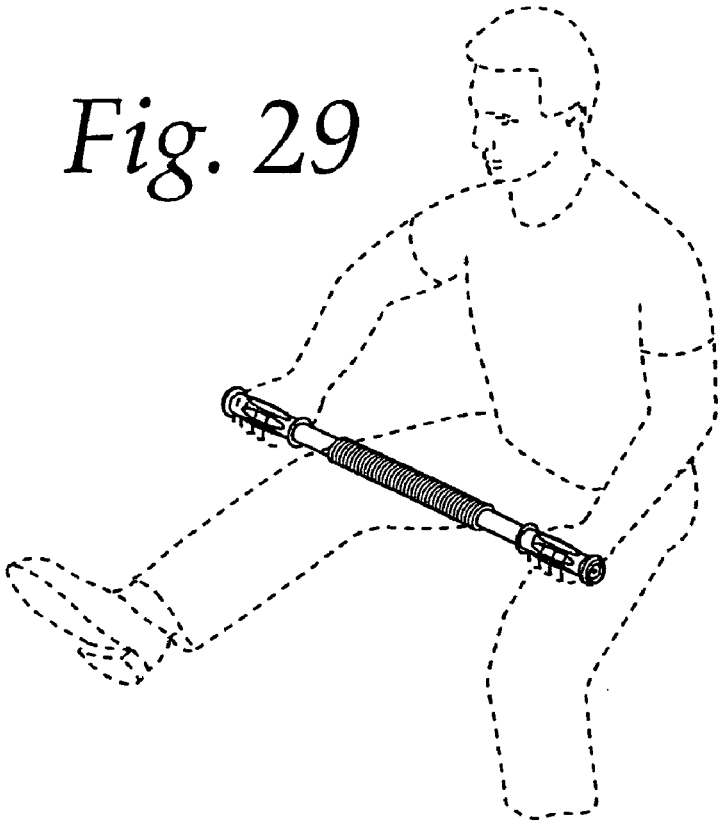
FIG. 29 illustrates another exercise method in accordance with the present invention for strengthening the thigh muscles in which a flexible bar is placed over a user's knee joint while the user's leg is in an extended position while the flexible bar is grasped on both ends by the user's hands in a relaxed position.
Figure 30:
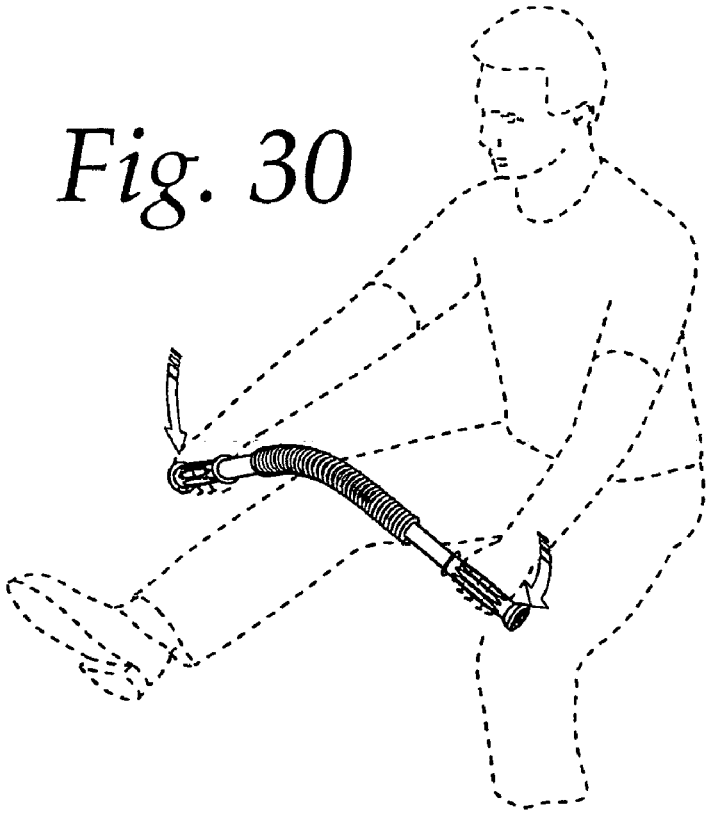
FIG. 30 is similar to FIG. 29 but illustrating a flexed position
Figure 31:
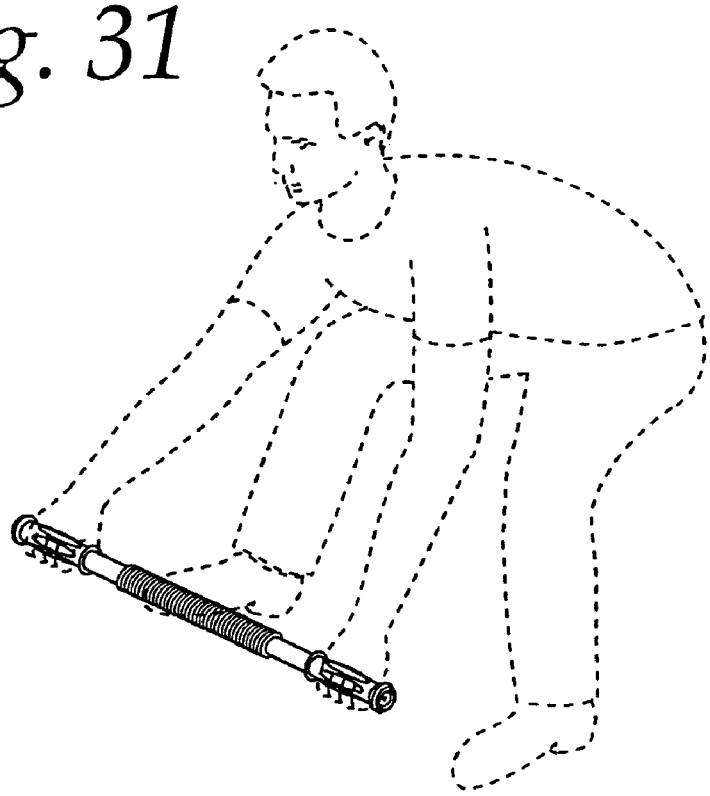
FIG. 31 illustrates another exercise method in accordance with the present invention for strengthening the calf muscles in which a flexible bar is placed under a user's toes while the user is in a seated position and the flexible bar is grasped on both ends by the user's hands illustrating a relaxed position.
Figure 32:
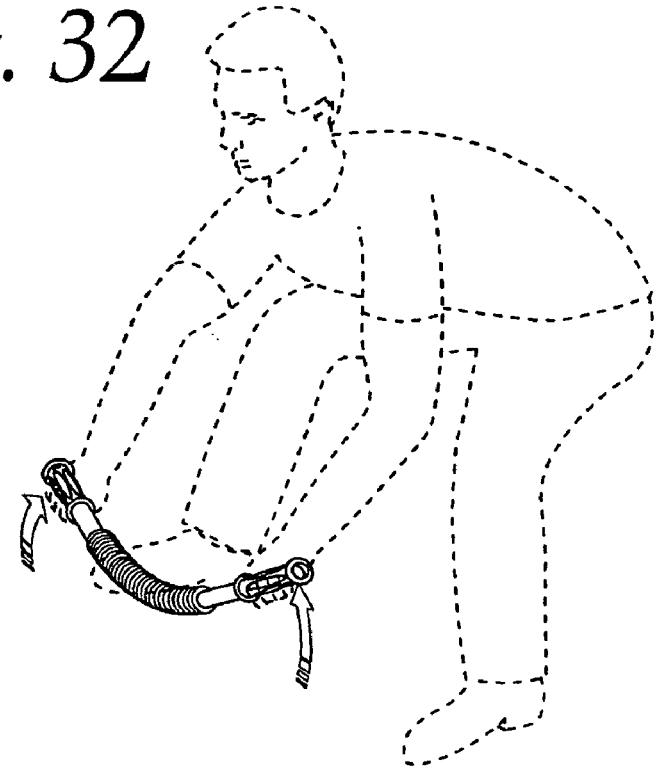
FIG. 32 is similar to FIG. 31 but illustrating a flexed position
Figure 33:
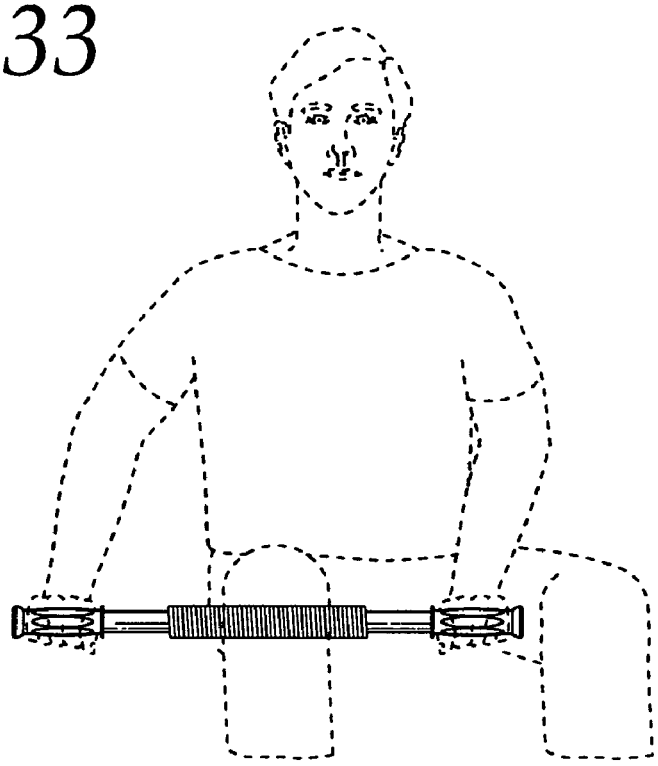
FIG. 33 illustrates another exercise method in accordance with the present invention for strengthening the forearm muscles in which a flexible bar is placed under a user's knee and grasped on both ends by the user's hands illustrating a relaxed position.
Figure 34:
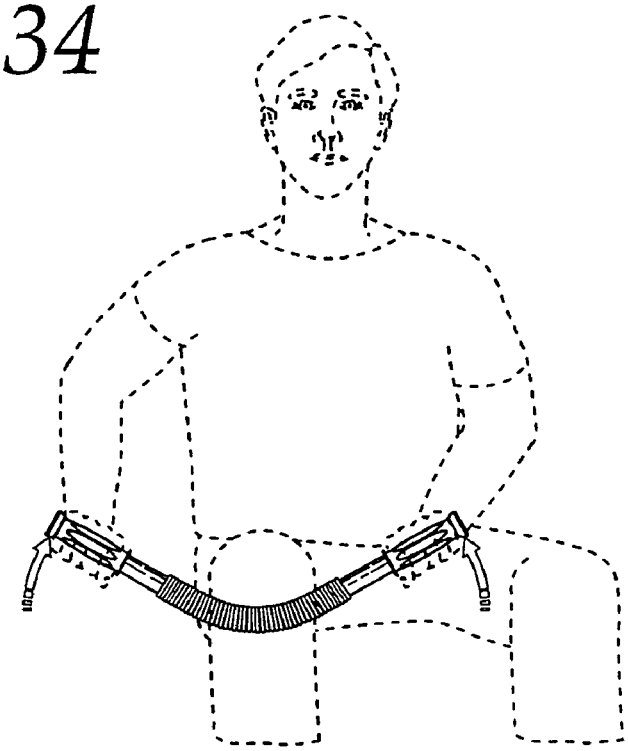
FIG. 34 is similar to FIG. 33 but illustrating a flexed position
Figure 35:
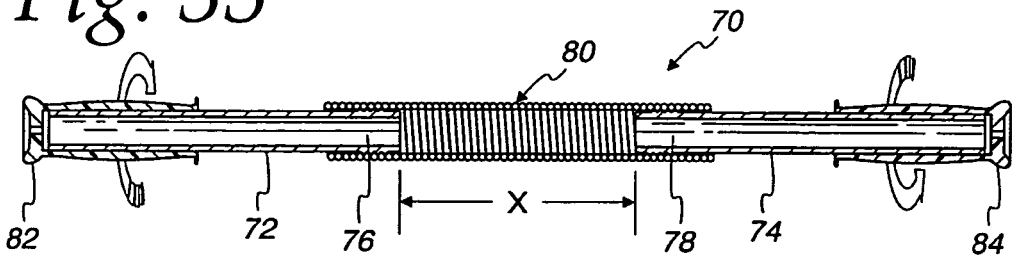
FIG. 35 is an alternate embodiment of the invention illustrated in FIG. 1 which includes an exemplary adjustable tension mechanism, shown in an at rest position at a first tension level.
Figure 36:
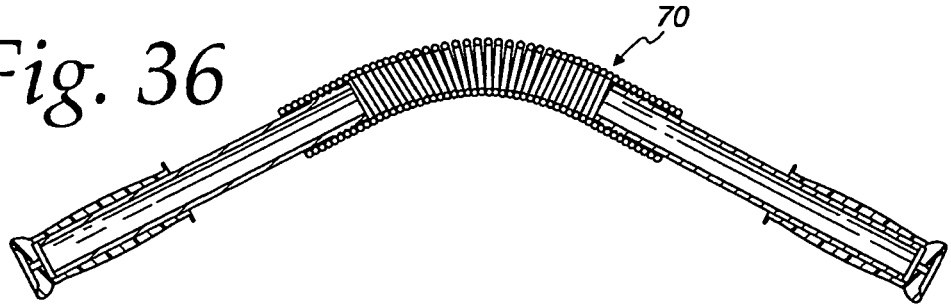
FIG. 36 is similar to FIG. 35 but shown in a flexed position.
Figure 37:
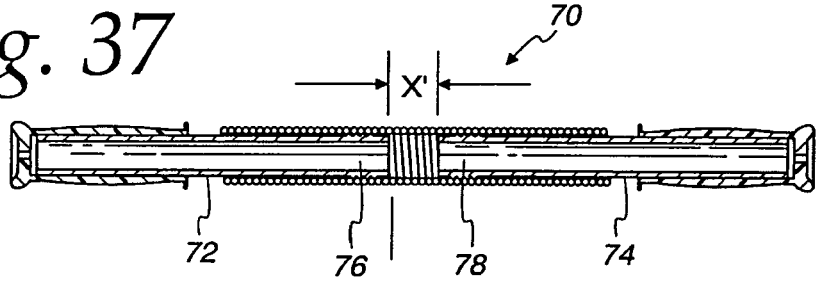
FIG. 37 is similar to FIG. 35 but shown at a second tension level.
Figure 38:
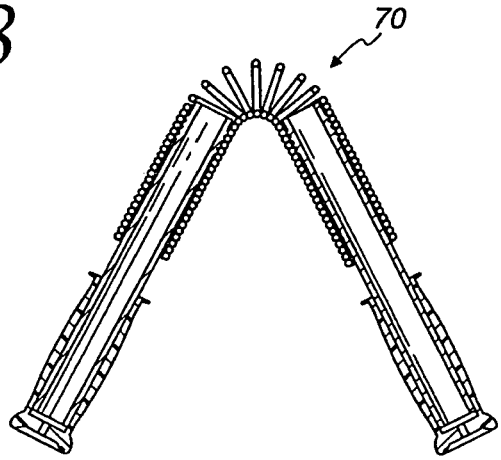
FIG. 38 is similar to FIG. 37 but shown in a flexed position.

FIGS. 35-38 and 41-43 illustrate two alternative embodiments of the exercise bar illustrated, for example, in FIG. 5 with an adjustable tension mechanism. In particular, FIG. 35 illustrates the exercise bar 70 in a rest position at a first tension level. FIG. 36 illustrates the exercise bar 70 in a flex position. FIG. 37 illustrates the exercise bar 70 in a rest position at a second tension level different than the tension level illustrated in FIG. 35. FIG. 38 illustrates the exercise bar 70 in a flex position at the second tension level illustrated in FIG. 37.

Referring to FIGS. 35-38, an exercise bar with an adjustable tension mechanism is illustrated and generally identified with the referenced numeral 70. The exercise bar 70 includes two spaced-apart handle bars 72, 74 that are threaded on one end 76, 78. The handle bars 72, 74 are coupled together by a spring 80. The inner diameter of the spring 80 and the outer diameter of the handle bars 72, 74 is selected to provide a relatively tight friction fit therebetween so that the ends 76, 78 of the handle bars 72, 74 can be screwed into the ends of the spring 80. Opposing ends of the handle bars 72, 74 may be provided with handle grips 82, 84. The handle grips 82, 84 are selected so as to provide a friction fit relative to the handle bars 72, 74.

As shown in FIG. 35, rotation of the handle grips 82, 84 and thus the handle bars 72, 74 causes the ends 76, 78 to be screwed into or screwed out of the spring 80 depending on the direction of rotation. In other words, rotation of the handle bars 72, 74 varies the effective length x of the spring 80. As known in the art, varying the length of the spring varies the tension since the spring constant of the spring 80 is fixed. Thus, by rotating the handle bars 72, 74, the spring tension of the spring 80 can be varied. FIG. 37 illustrates a condition in which the distance x prime between the ends 76, 78 of the handle bars 72, 74 is relatively less than the distance x illustrated in FIG. 35.

An alternate embodiment of the tension mechanism is illustrated in FIGS. 41-43 and generally identified with the reference numeral 90. FIG. 43 illustrates an alternative embodiment of the exercise bar, generally identified with the reference numeral 92, shown in a flexed position. FIGS. 41 and 42 illustrate the adjustable tension mechanism 90 in a first and second tension levels respectively.

Referring to FIG. 43, the tension mechanism 90 includes a rotatable cylindrical member 94 at one end. The rotatable cylindrical member 94 includes an elongated stud 96 threaded on one end 98. A nut follower 100 is screwed onto the threaded end 98. A cable 102 is attached to an end of the nut follower 100. A biasing spring 104 is disposed around the elongated stud 96 between the nut follower 100 and a pair of stops 106. The cable 102 is secured to an opposing end 108 of the exercise bar 70, as shown. In operation, as the cylindrical member 94 is rotated, the nut follower 100 will travel along the threaded portion 98 of the extended stud 96 either compressing or releasing the tension on the spring 104.

FIGS. 39 and 40 illustrate another alternate embodiment of the exercise bar, illustrated in FIG. 5, which includes a length adjustment mechanism of the handle bars. In this embodiment, one or both ends of the handle bars may be provided with telescoping members 110, 112. The inner telescoping member 110 may be provided with a spring biased bullet pin, for example, the bullet pin 114 illustrated in FIG. 40. The outer telescoping member 112 may be provided with a number of through holes, generally identified with the reference numeral 116. The length of the exercise bar is adjusted by depressing the bullet pins 114 and sliding the inner telescoping member 110 with respect to the outer telescoping member 112. When the desired length is achieved, the spring biased bullet pin will be received in the desired aperture representing the desired length to lock the telescoping members 110, 112 together.

Exercise Methods

FIGS. 5-34 illustrate various exemplary exercise methods in accordance with the present invention. In each of these methods, a flexible or deformable bar, for example, as disclosed above without the spacer, or otherwise, for example, as commercially available by Nautilus, may be used. Virtually any deformable or flexible bar is suitable. In accordance with an important aspect of the invention, the flexible bar is placed against the user's body, forming a fixed pivot point. For each exercise, the flexible bar is flexed and released as shown in FIGS. 5-34. The cycle is repeated as desired by the user.

The invention also relates to an exercise program or method for teaching third parties exercise methods in which a flexible bar is placed in contact with the user's body which result in the user's body acting as a fixed pivot point for the flexible bar. The exercise methods may be as illustrated in FIGS. 5-34 or otherwise.

Obviously, many modifications and various of the present invention are possible in light of the above teachings. Thus, it is to be understood that, within the scope of the appended claims, the invention may be practiced otherwise than is specifically described above.

I claim:

1. An exercise device comprising:

a pair of spaced apart generally straight rigid members;

a flexible coupling member for coupling said rigid members together forming a generally straight device when said flexible coupling member is not under tension; and a spacer, disposed adjacent to said flexible coupling member, said spacer for spacing said coupling member from a user's chest, said spacer configured to enable the user's chest to form a pivot point for the device in operation, said spacer sized to enable said user to pull back on said straight rigid members when said spacer is placed against said user's chest in order to exercise said user's back muscles in order to improve said user's posture.

2. The exercise device as recited in claim 1, wherein said flexible coupling member and said spacer are integrally formed.

3. The exercise device as recited in claim 1, wherein said spacer is formed as a separate components from said pair of spaced apart rigid members and said flexible coupling member.

4. The exercise device as recited in claim 1, wherein said spacer is formed from a deformable material.

5. The exercise device as recited in claim 1, wherein said spacer is formed from a non-deformable material.

6. The exercise device as recited in claim 1, wherein said flexible coupling member is a spring.

7. An exercise method for use with a flexible bar, the method comprising the steps of:

a) placing an exercise device formed from a pair of spaced apart generally straight rigid members coupled together with a flexible member forming a generally straight device when said flexible member is not under tension that includes a spacer sized to enable said user to pull back on said straight rigid members when said spacer is placed against said user's chest in order to exercise said user's back muscles in order to improve said user's posture;

b) grasping the rigid members by way of the user's hands;

c) pulling back and releasing the rigid members in order to exercise the user's back; and c) repeating step c.

8. The method as recited in claim 7, further including the step of repeating steps a) through d).

9. A method for teaching one or more third parties an exercise method with an exercise device, the exercise method comprising the steps of:

a) placing an exercise device formed from a pair of spaced apart generally straight rigid members coupled together with a flexible member forming a generally straight device when said flexible member is not under tension which includes a spacer so that the spacer is placed against a user's chest, said spacer sized to enable said user to pull back on said straight rigid members when said spacer is placed against said user's chest in order to exercise said user's back muscles in order to improve said user's posture; and b) demonstrating the exercise device by placing the spacer against the user's chest and alternatively pulling back and releasing the rigid members to exercise the user's back muscles in order to improve the user's posture.

10. An exercise device comprising:

a pair of spaced apart generally straight rigid members:

a flexible coupling member for coupling said rigid members together forming a generally straight device when said flexible coupling member is not under tension;

an adjustment mechanism for adjusting the tension of said device; and a spacer for spacing said exercise device from a user's body, said spacer configured to enable a user's chest to be used as a pivot point, said spacer sized to enable said user to pull back on said straight rigid members when said spacer is placed against said user's chest in order to exercise said user's back muscles in order to improve said user's posture.

11. An exercise device comprising:

a pair of spaced apart generally straight rigid members:

a flexible coupling member for coupling said rigid members together and forming a generally straight device when said flexible coupling member is not under tension;

an adjustment mechanism for adjusting the length between said spaced apart a generally straight rigid members; and a spacer for spacing said exercise device from a user's body, said spacer configured to enable a user's chest to be used as a pivot point said spacer sized to enable said user to pull back on said straight rigid members when said spacer is placed against said user's chest in order to exercise said user's back muscles in order to improve said user's posture.

* * * * *